US005739449A

United States Patent [19]

Torres, Jr.

[11] Patent Number: 5,739,449

[45] Date of Patent: Apr. 14, 1998

[54] COLLAPSIBLE DRUM STAND

[76] Inventor: Manuel A. Torres, Jr., 15 Brighton Ct., Daly City, Calif. 94015

[21] Appl. No.: 539,082

[22] Filed: Oct. 4, 1995

[51] Int. Cl.[6] ..... G10D 13/02

[52] U.S. Cl. ..... 84/421; 248/188.7; 248/346.01

[58] Field of Search ..... 84/421, 453; 248/346.01, 248/346.3, 346.5, 188.7

[56] References Cited

U.S. PATENT DOCUMENTS 1,561,371 11/1925 Strupe ..... 84/421

2,386,306 10/1945 Gardiner ..... 248/188.7

3,637,179 1/1972 Marschak ..... 248/188.7

5,137,237 8/1992 Haskins ..... 248/346.01

*Primary Examiner*—Cassandra C. Spyrou

[57] ABSTRACT

The present invention relates to a collapsible hand drum stand that is light weight and easily transportable. The collapsible drum stand is composed of at least four legs upon which the drum rests allowing a space between the bottom opening of the drum and the floor.

4 Claims, 6 Drawing Sheets

COLLAPSIBLE DRUM STAND

BACKGROUND OF THE INVENTION

1. Field of the Invention

The present invention relates to a drum stand. More particularly, the present invention relates to drum stand which has four to six legs with varying height for different types of drums and is collapsible for compact storage.

2. Description of the Prior Art

The present invention relates to a collapsible drum stand which is for hand drummers. Drums such as conga drums are tall cylindrical drums having an opening at the bottom end and the drum skin covering the top opening. Normally the drum is positioned whereas the bottom opening is placed flat or tilted on the floor which impeded the drum sound from emanating when a user strikes the top drum skin producing sound within the cylindrical drum.

The drum stands have been present in the art for decades but none address the problem of conga drums which are tall and cylindrical in design. A conga drum stand must be stable and able to support the weight of a large conga drum often weighing in excess of 70 pounds. The stand must also be able to suspend the conga drum a narrow distance being approximately ¼–1 inch from the floor.

Numerous innovations for drum stands have been provided in the prior art that are described as follows. Even though these innovations may be suitable for the specific individual purposes to which they address, they differ from the present invention as hereinafter contrasted.

In U.S. Pat. No. 4,640,175, Titled, Support Leg for Bass Drum, invented by Yoshihiro Hoshino comprises a support leg for a bass drum is provided. A circular surface is provided on the base member attached to the drum which has a positioning member thereon. A shaft means projects from the center of the circular surface, one end of which is attached to the base member. Inner and outer block members surround the shaft and have mutually facing surfaces for holding the leg member. The inner block has a mating circular surface which slidably mates with the circular surface of the base member and another positioning member which mates with and engages the positioning member. A means, is provided on other end of the shaft, for releasably engaging the outer block and urging the blocks together. A first spring means between the blocks has a spring pressure for urging the blocks apart. A member connects the blocks for setting and holding a predetermined gap between the blocks. A second spring means is provided between the inner block and base member and has a spring pressure for urging the inner block and base apart. The spring pressure of the second spring means is smaller than the spring pressure of the first spring means. When the outer block is released, the gap between the inner and outer blocks widens to the predetermined gap by the coaction of the first spring means between the inner and outer blocks loosening the leg member therebetween. A gap between the base and inner block is subsequently created by the coaction of the second spring means between the inner block and base to permit rotation of the leg holding member on the base and disengagement of the first and second positioning members.

This patented invention differs from the present invention due to the features that it is specifically designed for bass drums which are played with foot pedals having a mallet beater attached thereto. In addition, the support leg of the patented invention provides support but it is permanently attached to the drum in contrast to the present invention which is removable and collapsible.

In U.S. Pat. No. 3,561,716, Titled, Percussion Instrument Support, invented by, Joseph B. Thompson, comprises an adjustable stand for cymbals and other small percussion devices (traps), wherein a lug has provided therein means to define elongated parallel mils having relatively sharp edges. Mounted in the lug, and adjacent such rails, is a generally cylindrical shaft in which is formed a large number of longitudinal grooves adapted to receive the rail edges. A setscrew is provided to force the shaft against the rails, so that the rail edges seat in the grooves and lock the shaft against rotation whereby to prevent undesired movement of the cymbal (or other percussion device) which is connected to the shaft.

The above described patented invention differs from the present invention due to the features that it is primarily intended for supporting cymbals, jam blocks, and cowbells whereas the present invention is intended for hand drums such as congas, djembe and most African drums. In addition, the design of the present invention is that it projects sound from the drum and is removably positioned beneath the drum in contrast to the present invention which is permanently mounted on top of the drum.

In U.S. Pat. No. 4,869,147 Titled, Attachment of Support Leg for Base Drum, invented by, Yoshihiro Hoshino, comprises a holding and positioning member for a leg of a bass drum to provide a support for the drum. A seat plate attached to the drum body is provided with a pair of grooves defining an inverted V and passing on opposite sides of a screw hole. An additional groove is provided transverse to the V grooves. The leg may be selectively supported in any of the grooves. A cover plate is secured over the seat plate by a screw passing through the cover plate and the seat plate. Bosses on the cover control tilting when the cover is tightened over the seat plate and the leg spring between the cover and the seat plate permits the cover to flit.

The above described patented invention differs from the present invention due to the features that it is designed for a base drum rather than a traditional hand drum as depicted in the present invention. In addition, the support legs for the bass drum are permanently mounted upon the drum requiring drilling of holes and fastening of mounting brackets thereon whereas the present invention is positioned removably underneath the hand drum which sits atop of the stand. Furthermore, the patented invention is adjustable in angle, direction and length whereas the present invention maintains one angle and one height which is standard for most players.

Numerous innovations for drum stands provided in the prior an that are adapted to be used. Even though these innovations may be suitable for the specific individual purposes to which they address, they would not be suitable for the proposes of the present invention as heretofore described.

SUMMARY OF THE INVENTION

The collapsible drum stand is intended for hand drummers. Primary usage, or target audience are for "conga" drummers who choose to play in the traditional manner, sitting down. The acoustic characteristics of the location may impose other positions to achieve proper sound. The shorter six legged stand is for the "tumbadora", which is the "Low pitch" drum. This drum sits to your right, or left of your "conga"(main drum) which has a higher pitch. The taller stand, "four legged", can be used for the conga, or a "Quinto" (3rd drum) which has a higher pitch than the "conga or Tumbadora". The drum(s) are placed over the stands or, as the name state "inadrum".

The types of problems encountered in the prior art are elevation of the, hand drum to allow the player to achieve a "full" rich sound and the stand must be light weight as well as easily portable.

In the prior art, unsuccessful attempts to solve this problem were attempted namely: stands for bass drums and/or stands which are permanently mounted on the hand drum which elevate the drum from the floor. However, the problem was solved by the present invention because the design allows for collapsibility of the stand which is inherently fight weight and easily portable.

Innovations within the prior an are rapidly being exploited for hand drum stands due to the upsurge of Caribbean and African type music.

The present invention went contrary to the teaching of the art which exhibits mounting brackets which are permanently mounted on a drum.

The present invention solved a long felt need of a light weight compact portable stand for hand drums.

The present invention produced unexpected results namely: stabilization of the hand drum relative to the floor as well as a fuller and richer sound emanating from the hand drums which were mounted upon the present invention.

A synergistic effect was produced utilizing the present invention due to the following facts and results from experimentation: the angle of the hand drum could be positioned upon the collapsible drum stand in such a way that the top is angled toward the user whereby the bottom front of the drum opening is higher than the rear thereby projecting sound from the drum bouncing off of the floor in a direct line being a forward direction.

Accordingly, it is an object of the present invention to provide a hand drum stand which elevates the drum from the floor to provide a much richer and fuller sound.

More particularly, it is an object of the present invention to provide a hand drum stand which is versatile and able to accommodate different hand drums.

In keeping with these objects, and with others which will become apparent hereinafter, one feature of the present invention resides, briefly stated, in the collapsible drum stand is that it is collapsible and can be stored within a hand drum for transportation.

When the collapsible hand drum is designed in accordance with the present invention, it is intrinsically light weight in design.

In accordance with another feature of the present invention, the height that the collapsible drum stand elevates a hand drum from the floor is between ¼ and ½ inches.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10—collapsible drum stand 10
12A—first drum leg 12A
12AA—first drum leg horizontal member 12AA
12ABA—first drum leg vertical left member 12ABA
12ABB—first drum leg vertical fight member 12ABB
12ACA—first drum leg floor left member 12ACA

12ACB—first drum leg floor right member 12ACB
12B—second drum leg 12B
12BA—second drum leg horizontal member 12BA
12BBA—second drum leg vertical left member 12BBA
12BBAA—second drum leg vertical left member core 12BBAA
12BBB—second drum leg vertical right member 12BBB
12BCA—second drum leg floor left member 12BCA
12BCB—second drum leg floor fight member 12BCB
12C—third drum leg 12C
12CA—third drum leg horizontal member 12CA
12CBA—third drum leg vertical left member 12CBA
12CBB—third drum leg vertical right member 12CBB
12CCA—third drum leg floor left member 12CCA
12CCB—third drum leg floor fight member 12CCB
14—fastener 14
14A—fastener end 14A
14B—fastener shaft 14B
14C—fastener nut 14C
16—hand drum 16
16A—hand drum bottom opening 16A
16B—hand drum skin 16B

BRIEF DESCRIPTION OF THE PREFERRED EMBODIMENT

DETAILED DESCRIPTION OF THE PREFERRED EMBODIMENT

Figure 1:
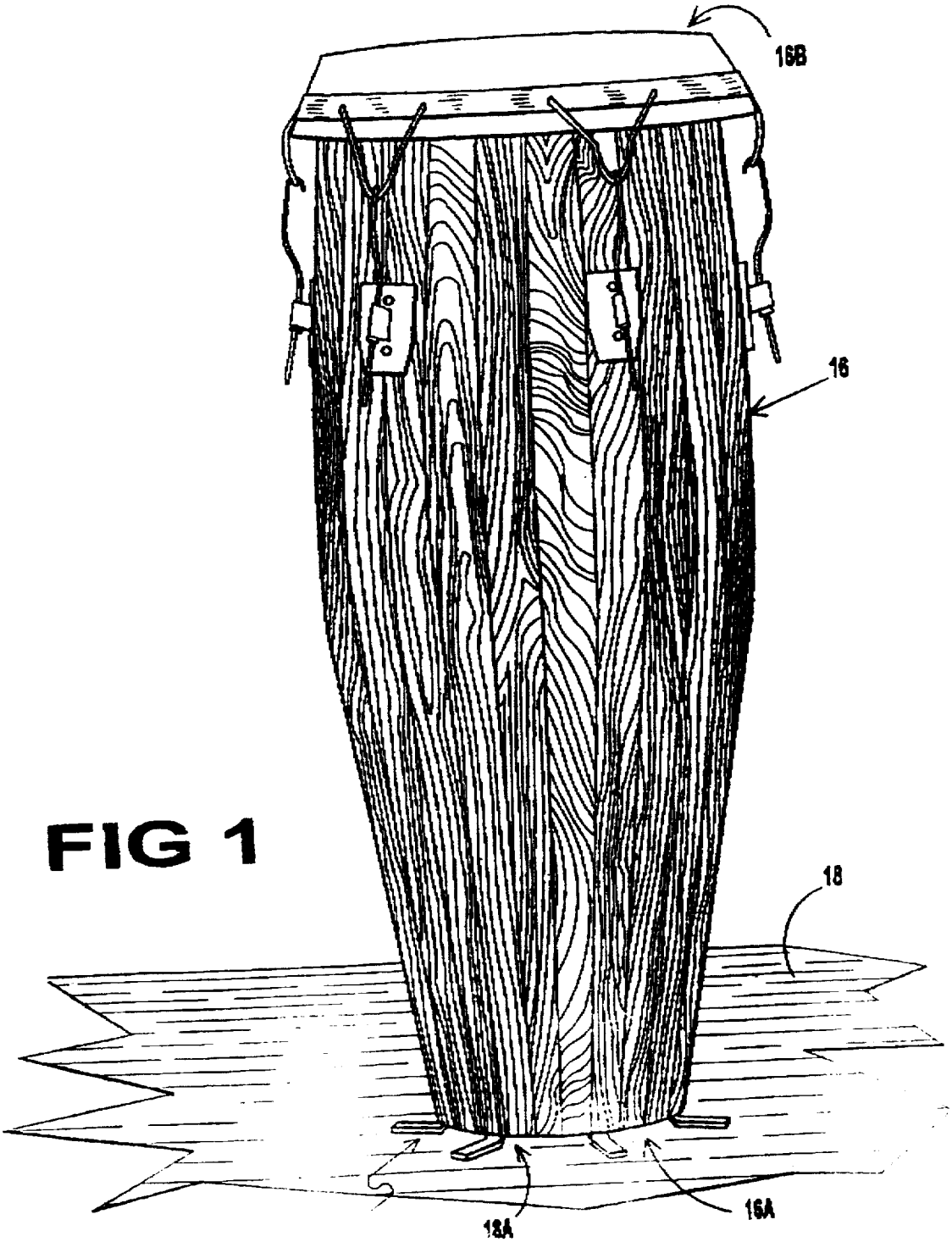
FIG. 1 is a side perspective view of a six legged collapsible drum stand positioned within a hand drum opening under a hand drum.

Firstly, referring to FIG. 1 which is a side perspective view of a six legged collapsible drum stand 10 positioned within a hand drum opening 16A under a hand drum 16. The drum 18 is elevated from the floor 18 about ¼ to ½ inches forming a floor gap 18A from which the rich full sound of the drum 16 emanated when a user strikes the hand drum skin 16B. The sound produced thereof emanates from the drum 16 through the drum bottom opening 16A bouncing off of the floor 18 and emanating outwardly.

Figure 2:
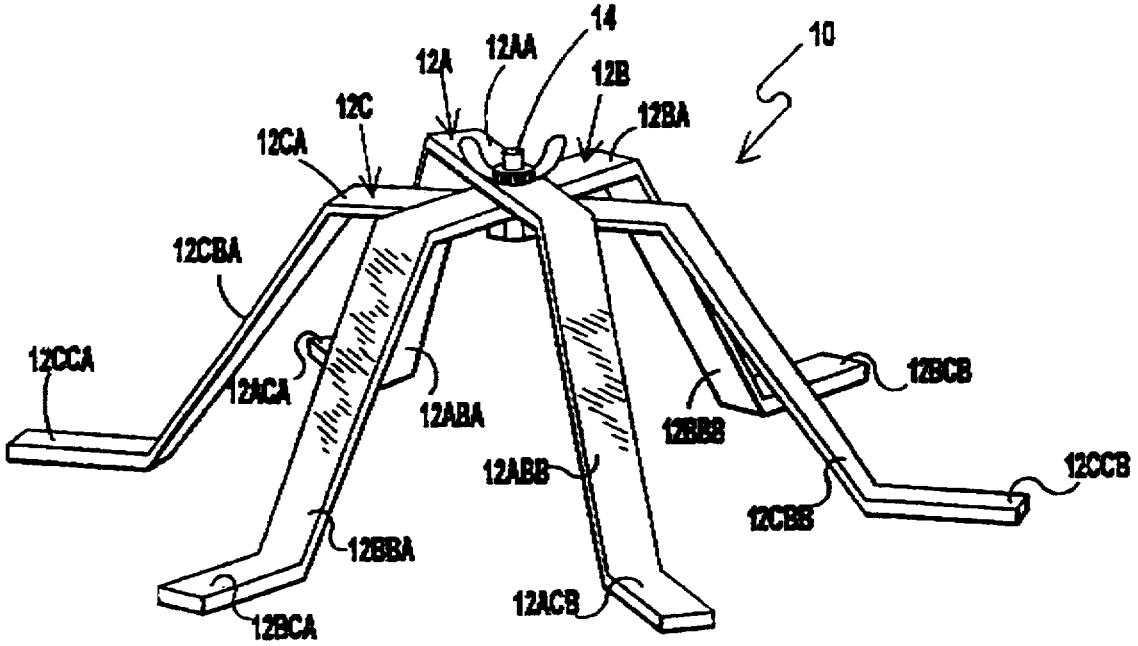
FIG. 2 is a is a six legged collapsible drum stand in a fully opened position.
Figure 3:
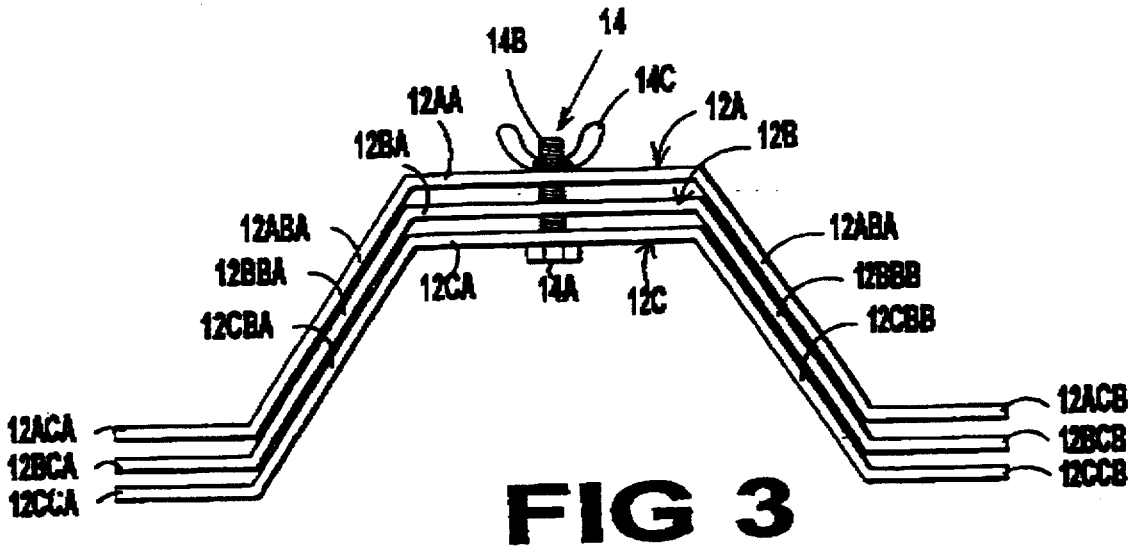
FIG. 3 is a six legged collapsible drum stand in a fully collapsed position.

Referring now to FIGS. 2 and 3 which is a six legged collapsible drum stand 10 in a fully opened and closed position respectively. The first drum leg 12A has a first drum leg horizontal member 12AA with an opening in the middle whereby the fastener shaft 14B is positioned through. At one distal end extending on an outward obtuse angle from the first drum leg horizontal member 12AA is a first drum leg vertical left member 12ABA. At a bottom distal end extending in an outward obtuse angle from the first drum leg vertical left member 12ABA is a first drum leg floor left member 12ACA which sits atop of the floor 18. At an opposite distal end extending on an outward obtuse angle from the first drum leg horizontal member 12AA is a first drum leg vertical fight member 12ABB. At a bottom distal end extending; in an outward obtuse angle from the first drum leg vertical right member 12ABB is a first drum leg floor fight member 12ACB which sits atop of the floor 18.

The second drum leg 12B has a second drum leg horizontal member 12BA with an opening in the middle whereby the fastener shaft 14B is positioned through. At one distal end extending on an outward obtuse angle from the second drum leg horizontal member 12BA is a second drum leg vertical left member 12BBA. At a bottom distal end extending in an outward obtuse angle from the second drum leg vertical left member 12BBA is a second drum leg floor left member 12BCA which sits atop of the floor 18. At an opposite distal end extending on an outward obtuse angle from the second drum leg horizontal member 12BA is a second drum leg vertical fight member 12BBB. At a bottom distal end extending in an outward obtuse angle from the second drum leg vertical fight member 12BBB is a first drum leg floor fight member 12BCB which sits atop of the floor 18.

The third drum leg 12C has a third drum leg horizontal member 12CA with an opening in the middle whereby the fastener shaft 14B is positioned through. At one distal end extending on an outward obtuse angle from the third drum leg horizontal member 12CA is a third drum leg vertical left member 12CBA. At a bottom distal end extending in an outward obtuse angle from the third drum leg vertical left member 12CBA is a third drum leg floor left member 12CCA which sits atop of the floor 18. At an opposite distal end extending on an outward obtuse angle from the third drum leg horizontal member 12CA is a third drum leg vertical fight member 12CBB. At a bottom distal end extending in an outward obtuse angle from the third drum leg vertical fight member 12CBB is a first drum leg floor fight member 12CCB which sits atop of the floor 18.

The six legged collapsible drum stand 10 usually mounts a tumbadora drum thereon to provide more stability to the heavier larger hand drum whereas a four legged collapsible drum stand 10 is utilized for the conga drum providing less stability and more movability. The fastener 14 has a fastener end 14A which is larger than the opening in the first, second and third drum leg horizontal member 12AA, 12BA, and 12CA. The opening is large enough to rotatably and slidably position a fastener shaft 14B therein. The fastener shaft 14B has a fastener nut 14C removably secured thereon. The preferred embodiment of the fastener nut 14C is a butterfly nut to facilitate loosening and tightening. The preferred height of the first, second and third drum leg horizontal member 12AA, 12BA, and 12CA from the floor is 4–6 inches for the six legged collapsible drum stand 10 whereas the four legged collapsible drum stand 10 is between 7–10 inches. By widening or narrowing the obtuse angle between the first, second and third drum leg horizontal member 12AA, 12BA, and 12CA and the first, second and third leg vertical left member 12ABA, 12BBA and 12CBA and concurrently widening or narrowing the obtuse angle between the first, second and third drum leg horizontal member 12AA, 12BA, and 12CA and the first, second and third leg vertical fight member 12ABB, 12BBB and 12CBB different hand drums 16 having different size hand drum openings 16A can be accommodated as well as the floor gap 18A being adjustable in height.

Figure 4:
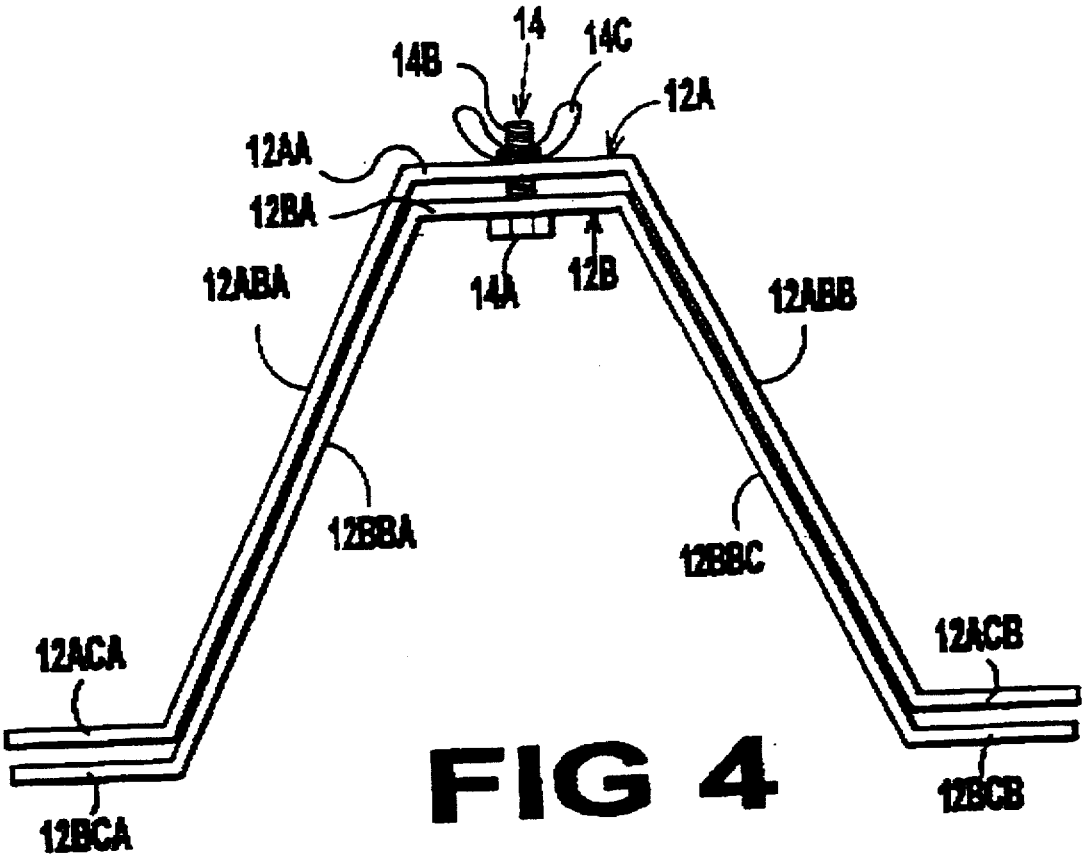
FIG. 4 is a four legged collapsible drum stand in a fully collapsed position.
Figure 5:
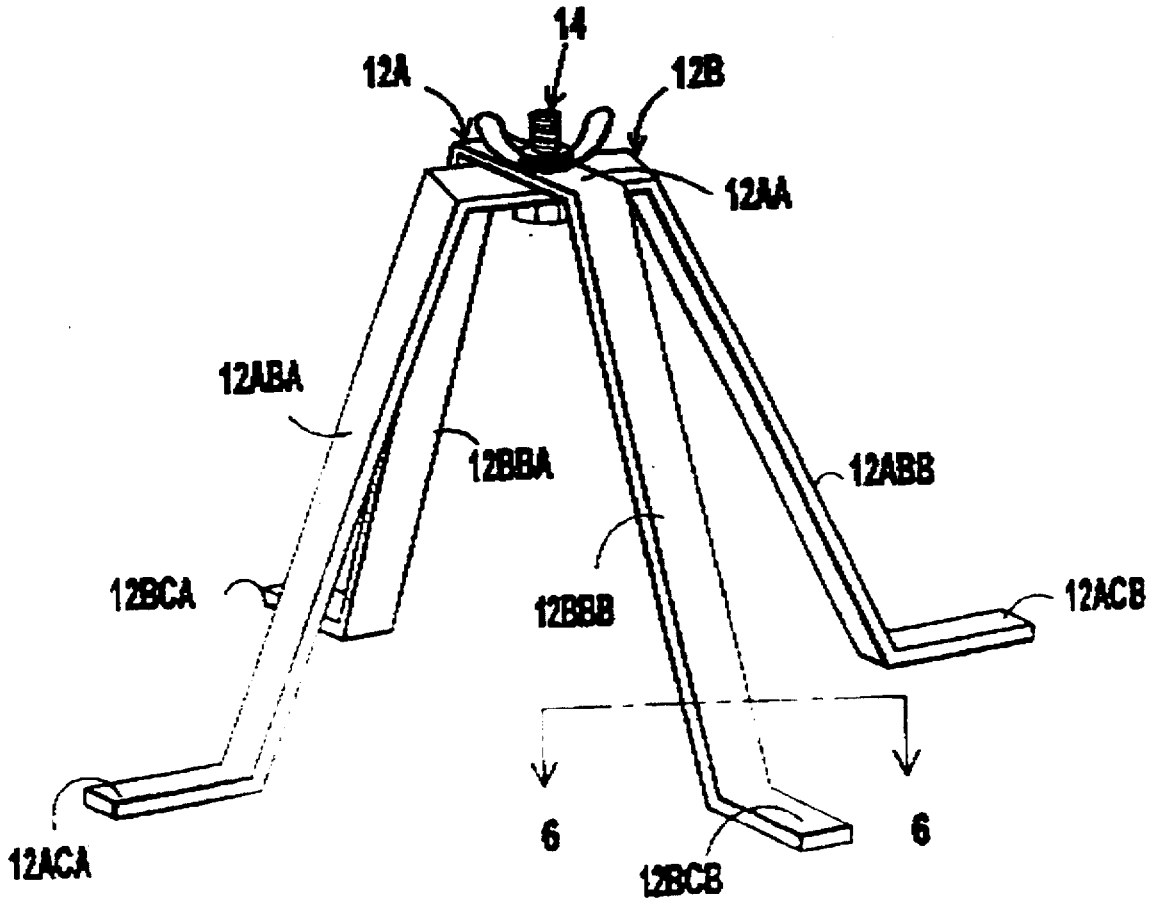
FIG. 5 is a four legged collapsible drum stand in a fully opened position.

Now referring to FIGS. 4 and 5 which are a four legged collapsible drum stand 10 in a fully collapsed and opened position, respectively. The four legged collapsible drum stand 10 is utilized for the conga drum and consists of a first drum leg 12A and a second drum leg rotatably secured therebetween by a fastener 14.

Figure 6:
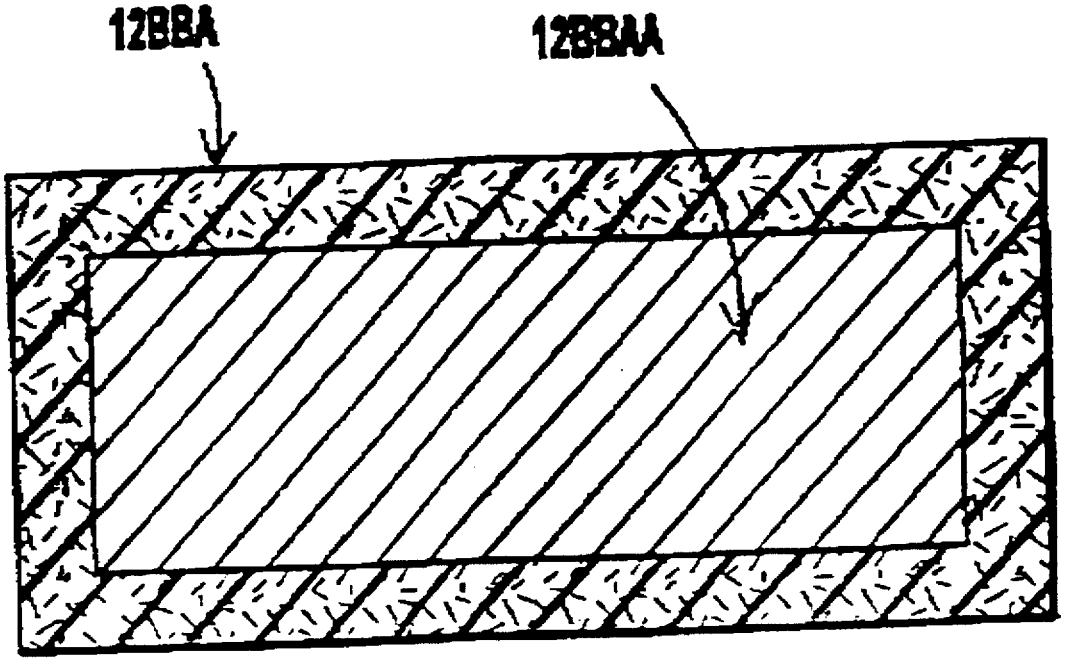
FIG. 6 is a cross sectional view of a second drum leg vertical left member exhibiting a solid core.

Lastly referring to FIG. 6 which is a cross sectional view of a second drum leg vertical left member 12BBA exhibiting a solid second drum leg vertical left member core 12BBAA. The second drum leg vertical left member core 12BBAA is preferably hollow for lightness and solid for strength.

The collapsible drum stand 10 has the first drum leg, second drum leg, and third drum leg manufactured from a group of materials consisting of metal, metal alloys, plastic, plastic composites, fiberglass, epoxy, carbon-graphite, rubber, rubber composites, and wood. The preferred embodiment is the collapsible drum stand 10 manufactured from metal alloy.

The collapsible drum stand has the first drum leg, second drum leg, and third drum leg being hollow to reduce weight.

The collapsible drum stand as described has the first drum leg, second drum leg, and third drum leg have a solid core for strength which is the preferred embodiment.

It will be understood that each of the elements described above, or two or more together, may also find a useful application in other types of constructions differing from the type described above.

While the invention has been illustrated and described as embodied in a collapsible drum stand, it is not intended to be limited to the details shown, since it will be understood that various omissions, modifications, substitutions and changes in the forms and derails of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A collapsible drum stand comprising:

a first drum leg comprising: a first drum horizontal member with an opening in the middle; a first drum vertical left member extending on an outward obtuse angle from one distal end of said first drum leg horizontal member; a first drum leg floor left member extending on an outward obtuse angle from a bottom distal end of said first drum vertical left member; a first drum vertical right member extending on an outward obtuse angle from an opposite distal end of said first drum leg horizontal member; a first drum leg floor right member extending on an outward obtuse angle from a bottom distal end of said first drum vertical right member;

a second drum leg comprising: a second drum leg horizontal member with an opening in the middle; a second drum vertical left member extending on an outward obtuse angle from one distal end of said second drum leg horizontal member; a second drum leg floor left member extending on an outward obtuse angle from a bottom distal end of said second drum vertical left member, a second drum vertical right member extending on an outward obtuse angle from an opposite distal end of said second drum leg horizontal member; a second drum leg floor right member extending on an outward obtuse angle from a bottom distal end of said second drum vertical right member; and, a fastener shaft passing through said opening of said first and second drum leg horizontal member.

2. The collapsible drum stand as described in claim 1, wherein the first drum leg and second drum leg are manufactured from a group of materials consisting of metal, metal alloys, plastic, plastic composites, fiberglass, epoxy, carbon-graphite, rubber, rubber composites, and wood.

3. The collapsible drum stand as described in claim 2, wherein the first drum leg and second drum leg are solid in core.

4. The collapsible drum stand as described in claim 1 further comprising:

a third drum leg comprising: a third drum leg horizontal member with an opening in the middle; a third drum vertical left member extending on an outward obtuse angle from one distal end of said third drum leg horizontal member; a third drum leg floor left member extending on an outward obtuse angle from a bottom distal end of said third drum vertical left member, a third drum vertical right member extending on an outward obtuse angle from an opposite distal end of said third drum leg horizontal member; a third drum leg floor right member extending on an outward obtuse angle from a bottom distal end of said third drum vertical right member; and, said fastener shaft passing though said opening of said third drum leg horizontal member.

* * * * *